United States Patent [19]

Dürr et al.

[11] Patent Number: 4,720,262

[45] Date of Patent: Jan. 19, 1988

[54] APPARATUS FOR THE HEAT TREATMENT OF FINE MATERIAL

[75] Inventors: Manfred Dürr, Oelde; Karl Krützner, Beckum; Heinz-Werner Thiemeyer; Jurgen Wurr, both of Ennigerloh; Peter Tiggesbäumker; Wolfgang Rother, both of Oelde, all of Fed. Rep. of Germany

[73] Assignee: Krupp Polysius AG, Beckum, Fed. Rep. of Germany

[21] Appl. No.: 1,247

[22] Filed: Jan. 7, 1987

Related U.S. Application Data

[63] Continuation of Ser. No. 771,616, Sep. 3, 1985, abandoned.

[30] Foreign Application Priority Data

Oct. 5, 1984 [DE] Fed. Rep. of Germany ..... 3436687

[51] Int. Cl.[4] ..... F27B 7/02

[52] U.S. Cl. ..... 432/106; 432/58; 432/14

[58] Field of Search ..... 432/58, 14, 106

[56] References Cited

U.S. PATENT DOCUMENTS

| | | | |
|---|---|---|---|
| 3,975,148 | 8/1976 | Fukuda et al. | 432/106 |
| 4,050,882 | 9/1977 | Kohl et al. | 432/14 |
| 4,050,883 | 9/1977 | Goldmann et al. | 432/14 |
| 4,060,375 | 11/1977 | Weber et al. | 432/58 |
| 4,071,309 | 1/1978 | Yamane | 432/14 |
| 4,257,766 | 3/1981 | Ritzmann et al. | 432/106 |
| 4,392,822 | 7/1983 | Brachthauser et al. | 432/106 |
| 4,490,109 | 12/1984 | Krutzner | 432/106 |
| 4,492,566 | 1/1985 | Kreft et al. | 432/14 |
| 4,579,526 | 4/1986 | Kreft et al. | 432/106 |

*Primary Examiner*—Henry C. Yuen

*Attorney, Agent, or Firm*—Learman & McCulloch

[57] ABSTRACT

Apparatus for the heat treatment of fine material comprises a multi-stage cyclone preheater, a rotary kiln and a calciner supplied with tertiary air from a cooler for precalcination of the preheated fine material. The tertiary air pipe is narrowed at the point where it joins into the calciner. In this way an intensification of the mixing together of material, fuel and gas is achieved as well as an improved combustion, particularly fuels which are slow to react.

13 Claims, 7 Drawing Figures

FIG. 2
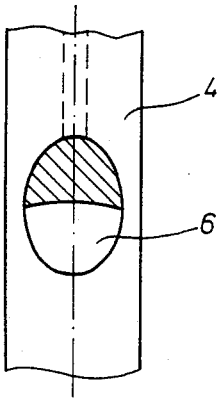
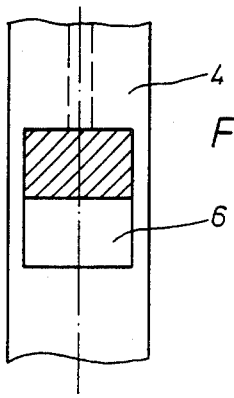
FIG. 3
FIG. 4
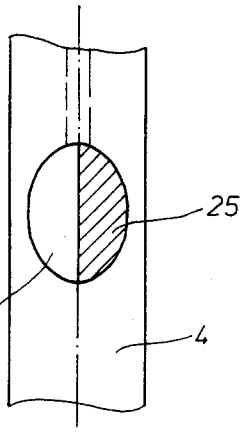
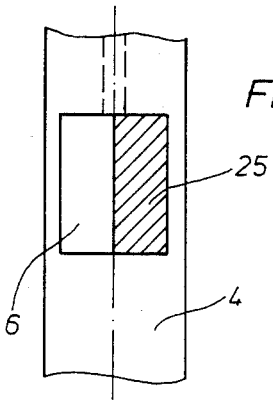
FIG. 5
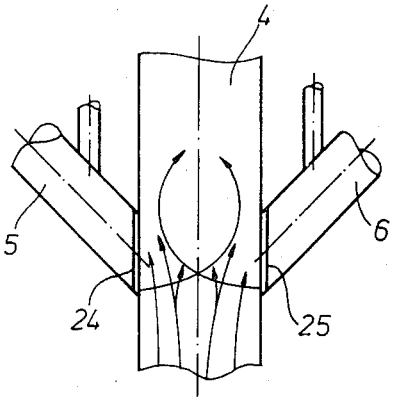
FIG. 6
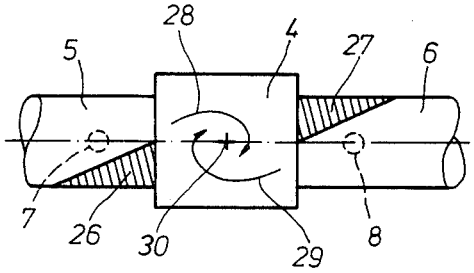
FIG. 7

APPARATUS FOR THE HEAT TREATMENT OF FINE MATERIAL

This is a continuation of co-pending application Ser. No. 771,616 filed on Sept. 3, 1985, abandoned.

This invention relates to apparatus for the heat treatment of fine material, particularly cement raw material.

BACKGROUND OF THE INVENTION

Apparatus of the general class to which the invention relates is disclosed in U.S. Pat. No. 4,257,766 to Ritzmann et al. In this case the downwardly-inclined part of the tertiary air pipe is constructed as a simple cylindrical pipe.

In order for the fine material from the second lowest stage of the cyclone preheater which is introduced into the tertiary air pipe to be satisfactorily aerated on the short available path (between the opening of the material pipe and the combustion zone) and to be reliably introduced into the combustion zone, it is known from U.S. Pat. No. 4,579,526 to Kreft et al for the downwardly-inclined part of the tertiary air pipe to be narrowed so as to increase the flow speed of the air at the opening of the material pipe and for the air pipe between the narrowed section and the calciner which forms the combustion zone to be constructed as a diffuser.

In the practical operation of such apparatus it has been found that in certain cases (particularly in the event of slowness of reaction of the fuel and/or the raw material) the combustion of the fuel and the deacidification of the raw material in the calciner are achieved to a limited extent only.

The object of the invention therefore is to construct apparatus of the type referred to in such a way that, even in the event of a slow reaction of the fuel and/or raw material, good combustion of the fuel and a high degree of deacidification in the calciner can be achieved.

This object is achieved according to the invention by narrowing the tertiary air pipe at the point where it joins the calciner.

SUMMARY OF THE INVENTION

The narrowing of the tertiary air pipe at the point where it joins the calciner significantly increases the speed of the tertiary air and thus its momentum on entry into the calciner. This results in better penetration of the tertiary air and the exhaust gases from the rotary kiln and better intermixing of the preheated fine material and the fuel in the gas stream. The increase in the turbulence at the point where the tertiary air pipe joins the calciner results in marked intensification of combustion, particularly in the initial phase.

If the tertiary air pipe is divided into two branch pipes of which each has a material pipe connected to it and join at opposing peripheral points the calciner and the tertiary air pipes are narrowed laterally, then according to the invention the restrictive points where the two branch pipes for the tertiary air join the calciner are offset with respect to one another in such a way that the two branch streams of tertiary air in the calciner form a rotational flow with a vertical axis.

As a result of this, even in the regions of the calciner located further downstream, there is a rotational flow component which ensures a good mixing together of fuel, fine material and air and complete combustion of the residue even when fuel which is very slow to react is used.

On the other hand, the strong rotational flow produced in the region where the two branch pipes for the tertiary air join the calciner is dissipated in the further course of the flow within the calciner and therefore the strands of material which occur in rotational flows and still include unreacted particles of fuel react with the surrounding gaseous atmosphere when the rotational flow breaks down. Tests have shown that the near and distant effects of the introduction of the tertiary air according to the invention result in both a considerable increase in the mixing effect in the downstream part of the calciner and a significant intensification of the combustion of fuel.

Tests showed that the flow speed of the tertiary air at the point where the branch pipes for the tertiary air join the calciner easily can be increased to twice the speed of the tertiary air in the unnarrowed part of the pipe without this causing the pressure loss of the whole plant to increase. The pressure potential which is in any case present between the calciner and the tertiary air pipe is sufficiently high to withstand a cross-sectional narrowing of the order of magnitude given above. In general the internal cross-section of the tertiary air pipe at the point where it joins the calciner is 25% to 75% of the unnarrowed cross-section of the pipe.

THE DRAWINGS

Advantageous embodiments of the invention are described in connection with several embodiments which are illustrated in the drawings, wherein FIG. 1 is a schematic representation of the parts of the apparatus according to the invention which are essential for an understanding of the invention;

FIG. 2 is a section along the line II—II in FIG. 1;

FIG. 3 is a section similar to FIG. 2 through a variant;

FIGS. 4 and 5 are sectional views of two further embodiments;

FIG. 6 is a side view of the embodiments of FIGS. 4 and 5; and

FIG. 7 shows a horizontal section through a further variant.

DETAILED DESCRIPTION

Figure 1:
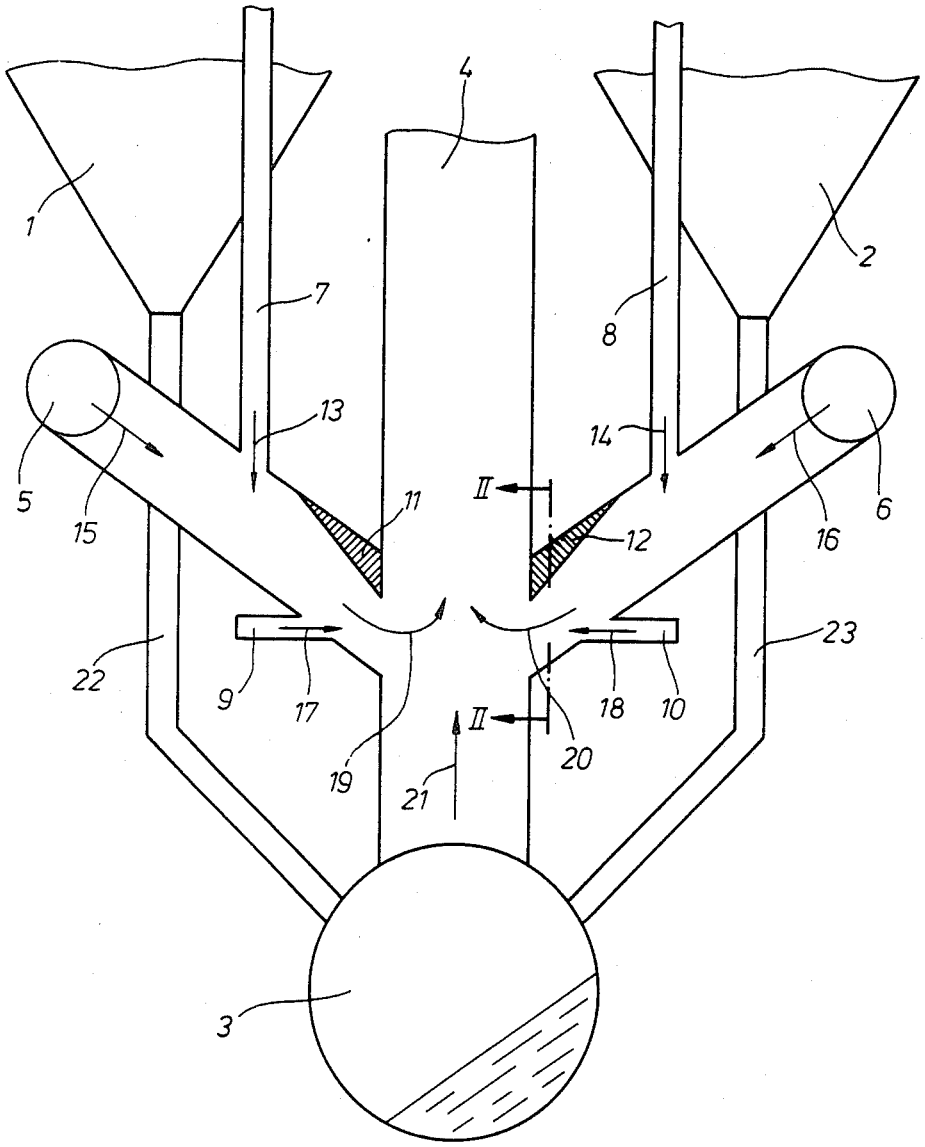

The apparatus which is illustrated schematically in FIG. 1 and is intended for the heat treatment of fine material, particularly cement raw material, contains a multi-stage cyclone preheater of which only the two cyclones 1 and 2 of the lowest stage are illustrated. The apparatus also contains a rotary kiln 3, and the exhaust gas pipe leading from this rotary kiln to the lowest stage of the cyclone preheater forms a calciner 4 for precalcination of the preheated fine material.

A downstream cooler (which is not shown) is connected to the rotary kiln 3 from which a tertiary air pipe which is divided into branch pipes 5 and 6 leads to the calciner 4. The part of the branch pipes 5, 6 for the tertiary air which opens into the calciner 4 is inclined downwards with respect to the horizontal in the direction of flow.

Material pipes 7, 8 which come from the second lowest stage (not shown) of the cyclone preheater open into the two branch pipes 5, 6 for the tertiary air.

Burners 9, 10 are also arranged in the branch pipes 5, 6 for the tertiary air close to the point where the branch pipes join the calciner 4.

According to the invention the two branch pipes 5, 6 for the tertiary air are narrowed at the point where they communicate with the calciner 4. In the embodiment illustrated in FIGS. 1, 2 and 3 the cross-section is narrowed by means of a wedge 11, 12 which increasingly reduces the cross-section of the pipe in the direction of flow of the tertiary air so that the narrowest cross-section of the pipe is located at the point where the branch pipes 5, 6 for the tertiary air open into the calciner 4. In the embodiment according to FIGS. 1, 2 and 3 the wedges 11, 12 are applied to the upper surface of the cross-section of the pipe, so that the point where the branch pipes for the tertiary air open into the calciner is narrowed by covering of the upper region of the cross-section. The wedges 11, 12 can be made of refractory material. It is of course also possible for the pipes to be constructed from the outset with the wedge shape. The inlet cross-sections of the two branch pipes 5, 6 for the tertiary air where they join the calciner 4 can be of any geometric shape required.

When the apparatus is in operation the fine material preheated in the cyclone preheater passes via the material pipes 7, 8 of the second lowest stage into the branch pipes 5, 6 for the tertiary air (arrows 13, 14) and is entrained by the branch streams of tertiary air (arrows 15, 16). The material/air mixture is then increasingly accelerated by the narrowed section formed by the wedges 11 and 12, is mixed together in the region of the burners 9, 10 with the fuel which is added there (arrows 17, 18) and then enters the calciner 4 at high speed. The mixture of material, fuel and tertiary air (arrows 19, 20) is entrained by the rising kiln exhaust gases (arrow 21) and deflected. Then the combustion of the fuel and the deacidification (precalcination) of the fine material take place in the calciner 4. The highly deacidified fine material which is separated off in the cyclones 1 and 2 of the lowest stage of the cyclone preheater then passes through the material pipes 22, 23 into the rotary kiln 3.

The cross-section of the openings of the branch pipes 5, 6 for the tertiary air into the calciner 4 can be of various shapes. FIG. 2 shows the narrowing of a round opening cross-section and FIG. 3 shows the narrowing of a rectangular opening cross-section. As already mentioned, other cross-sectional shapes are also possible.

Whereas in the embodiments according to FIGS. 1 to 3 the point where the branch pipes for the tertiary air open into the calciner is narrowed by covering the upper cross-section, FIGS. 4 to 7 show embodiments in which the point where the branch pipes for the tertiary air open into the calciner is narrowed by covering a lateral cross-sectional region. FIG. 4 shows the lateral narrowing of a round opening cross-section and FIG. 5 shows the lateral narrowing of a rectangular opening cross-section.

According to FIG. 6 the cross-sectional narrowing of the branch pipes 5 and 6 for the tertiary air is formed by a slide 24, 25 which is provided at the point where the branch pipes 5, 6 for the tertiary air join the calciner 4 and is advantageously adjustable.

In the case where the cross-sectional regions are narrowed laterally the narrowed cross-sectional regions of the openings of the two branch pipes for the tertiary air are advantageously offset relative to one another in such a way that the two branch streams of tertiary air are offset laterally relative to the vertical axis of the calciner when they enter the calciner 4.

FIG. 7 shows this in connection with the example of a lateral narrowing by means of wedges 26, 27. Each of the two wedges is located on the right-hand side (viewed in the direction of flow) of the relevant branch pipe 5, 6 for the tertiary air so that the branch streams of tertiary air 28, 29 are offset laterally relative to the vertical axis 30 of the calciner 4 when they enter the latter and form a rotational flow about a vertical axis in the calciner.

The material pipes 7, 8 open into the branch pipes 5, 6 for the tertiary air in such a way that the imaginary extension of the material pipes lies some distance away from the side walls of the branch pipes for the tertiary air, preferably centrally between these side walls. This ensures that when the fine material enters the branch pipes 5, 6 for the tertiary air it does not run directly along the side wall of the branch pipe for the tertiary air (which may already be somewhat narrowed there), but preferably enters centrally into the free cross-section of the branch pipes for the tertiary air. In this way the fine material is satisfactorily taken up by the tertiary air and the material is prevented from being deposited and caking on in the branch pipes for the tertiary air.

If the points where the branch pipes for the tertiary air communicate with the calciner are narrowed not be slides but, in order to avoid pressure losses and deposits, by wedges then these wedges can be made of refractory material. At the same time it is possible to construct any transitions in the pipe cross-section, for example a transition from a round cross-section in the unnarrowed part to an angular cross-section at the point where it opens into the calciner.

With the embodiments shown in FIGS. 1 to 7 the tertiary air pipe is divided into two branch pipes 5 and 6. The invention, however, can also be used when providing a single tertiary air pipe which is not divided so that the tertiary air enters the calciner from one side. Also in this case the narrowed opening will cause a high turbulence in the calciner. For this purpose the opening can be laterally offset as shown in FIG. 7 (with a single pipe, however).

We claim:

1. In apparatus for the heat treatment of fine material having:

(a) a kiln;

(b) a preheater;

(c) a calciner having a longitudinal axis joining the kiln and the preheater and forming a combustion zone for the precalcination of the preheated fine materials;

(d) air pipe means communicating with the calciner for supplying tertiary air thereto; and (e) material supply pipe means communicating with said air pipe means at a point upstream from said calciner for mixing said material and tertiary air;

the improvement comprising:

(f) means restricting the internal cross sectional area of said air pipe means at its juncture with said calciner for accelerating the speed at which mixed material and tertiary air are delivered into said calciner, thereby increasing turbulence within said calciner said restricting means comprising a wedge which increasingly reduces the cross sectional area of the pipe means in the direction of flow of the tertiary air, the narrowest cross sectional area being located at the juncture of the air pipe and the calciner.

2. Apparatus according to claim 1 wherein the internal cross sectional area of the air pipe means at its juncture with the calciner is between about 25% and 75% of the unrestricted cross section of such pipe means.

3. Apparatus according to claim 1 wherein said wedge is located at the uppermost cross sectional region of said air pipe means.

4. Apparatus according to claim 1 wherein said wedge is located at a lateral cross sectional region of said air pipe means.

5. Apparatus according to claim 1 wherein the material supply pipe means opens into said air pipe means in such a way that an imaginary extension of the material supply pipe means is between the opposite sides of said air pipe means.

6. In apparatus for the heat treatment of fine material having:

(a) a kiln;

(b) a preheater;

(c) a calciner having a longitudinal axis joining the kiln and the preheater and forming a combustion zone for the precalcination of the preheated fine materials;

(d) a pair of air pipe means each of which communicates with the calciner for supplying teritary air thereto; and (e) material supply pipe means communicating with each of said air pipe means at a point upstream from said calciner for mixing said material and tertiary air;

the improvement comprising:

(f) means restricting the internal cross sectional area of each of said air pipe means at its juncture with said calciner for accelerating the speed at which mixed material and tertiary air are delivered into said calciner, thereby increasing turbulence within said calciner, said restricting means comprising a wedge which increasingly reduces the cross sectional area of the pipe means in the direction of flow of the tertiary air, the narrowest cross sectional area being located at the juncture of the air pipe means and the calciner.

7. Apparatus according to claim 6 wherein each of said air pipe means communicates with said calciner at a point peripherally spaced from that at which the other communicates with said calciner.

8. Apparatus according to claim 7 wherein the points at which said air pipe means communicate with said calciner are peripherally offset relative to one another a distance such that the mixed material and tertiary air streams delivered into said calciner form a rotational flow about the axis of said calciner.

9. Apparatus according to claim 6 wherein the juncture of each of said air pipe means with the calciner is offset laterally relative to the zxis of the claciner.

10. Apparatus according to claim 9 wherein the juncture of each of said air pipe means with the calciner is offset laterally to such an extent that they do not overlap each other.

11. Apparatus according to claim 6 wherein the juncture of each of said air pipe means with said claciner is offset vertically relative to the other.

12. In apparatus for the heat treatment of fine material having:

(a) a kiln;

(b) a preheater;

(c) a calciner having a longitudinal axis joining the kiln and the preheater and forming a combustion zone of the precalciantion of the preheated fine materials;

(d) air pipe means communicating with the calciner for supplying teritary air thereto; and (e) material supply pipe means communicating with said air pipe means at a point upstream from said calciner for mixing said material and tertiary air;

the improvement comprising:

(f) means restricting the internal cross sectional area of said air pipe means its juncture with said calciner for accelerating the speed at which mixed material and tertiary air are delivered into said calciner, thereby increasing turbulence within said calciner, said restricting means comprising an adjustable slide.

13. In apparatus for the heat treatment of fine material having:

(a) a kiln;

(b) preheater;

(c) a claciner having a longitudinal axis joining the kiln and the preheater and forming a combustion zone for the precalcination of the preheated fine materials;

(d) a pair of air pipe means each of which communicates with the claciner for supplying tertiary air thereto; and (e) material supply pipe means communicating with each of said air pipe means at a point upstream form said calciner for mixing said material and tertiary air;

the improvement comprising:

(f) means restricting the internal cross sectional area of each of said air pipe means at its juncture with said claciner for accelerating the speed at which mixed material and tertiary air are delivered into said calciner, thereby increasing tubulence within said calciner, said restricting means comprising an adjustable slide.

* * * * *

UNITED STATES PATENT AND TRADEMARK OFFICE

CERTIFICATE OF CORRECTION

PATENT NO. : 4,720,262

DATED : January 19, 1988

INVENTOR(S) : Manfred Durr et al

It is certified that error appears in the above-identified patent and that said Letters Patent is hereby corrected as shown below:

Column 4, line 65, after "pipe" insert -- means -- .

Column 6, line 3, change "zxis" to -- axis -- ; line 17, change "of", the first occurrence, to -- for -- ; line 26, after "means" insert -- at -- ; line 52, change "tubulence" to -- turbulence -- .

Signed and Sealed this

Nineteenth Day of July, 1988

*Attest:*

DONALD J. QUIGG

*Attesting Officer*

*Commissioner of Patents and Trademarks*